US008537058B2

(12) United States Patent
Kao

(10) Patent No.: US 8,537,058 B2
(45) Date of Patent: Sep. 17, 2013

(54) ANTENNA ASSEMBLY AND ELECTRONIC DEVICE USING THE SAME

(75) Inventor: Kung-Ming Kao, Tu-Cheng (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 397 days.

(21) Appl. No.: 12/955,027

(22) Filed: Nov. 29, 2010

(65) Prior Publication Data

US 2012/0050115 A1 Mar. 1, 2012

(30) Foreign Application Priority Data

Aug. 25, 2010 (TW) ..... 99128427 A

(51) Int. Cl.
*H01Q 1/24* (2006.01)

(52) U.S. Cl.
USPC ..... 343/702

(58) Field of Classification Search
USPC ..... 343/702, 880, 757, 700 MS
See application file for complete search history.

(56) References Cited

U.S. PATENT DOCUMENTS

| | | | | |
|---|---|---|---|---|
| 6,172,645 | B1 * | 1/2001 | Hollander et al. | 343/702 |
| 6,501,429 | B2 * | 12/2002 | Nakamura et al. | 343/702 |
| 6,933,896 | B2 * | 8/2005 | Sward et al. | 343/702 |
| 7,286,092 | B2 * | 10/2007 | Trejtnar et al. | 343/757 |
| 7,342,542 | B2 * | 3/2008 | Sadamori et al. | 343/702 |
| 7,443,351 | B2 * | 10/2008 | Komine | 343/702 |
| 7,609,214 | B2 * | 10/2009 | Cha et al. | 343/702 |
| 2003/0160729 | A1 * | 8/2003 | Komiyama | 343/702 |

* cited by examiner

*Primary Examiner* — Huedung Mancuso
(74) *Attorney, Agent, or Firm* — Altis Law Group, Inc.

(57) ABSTRACT

An antenna assembly includes a slide mechanism, a chassis, and an antenna. The slide mechanism includes a fixed plate and a slide plate slidably mounted on the fixed plate. The chassis is mounted on the slide plate. The antenna is mounted on the chassis. The antenna is contained between the fixed plate and the slide plate when the slide mechanism is retracted, and exposed when the slide mechanism is extended.

9 Claims, 4 Drawing Sheets

ANTENNA ASSEMBLY AND ELECTRONIC DEVICE USING THE SAME

BACKGROUND

1. Technical Field

The present disclosure relates to an antenna assembly and an electronic device using the same.

2. Description of Related Art

An electronic device capable of receiving digital multimedia broadcasting (DMB) services, such as digital video broadcasting-terrestrial (DVB-T), is often provided with a TV antenna. However, the TV antenna is generally installed inside the electronic device, such that signal reception of the TV antenna is interfered.

Therefore, there is room for improvement within the art.

BRIEF DESCRIPTION OF THE DRAWINGS

Many aspects of the present disclosure can be better understood with reference to the following drawings. The components in the various drawings are not necessarily drawn to scale, the emphasis instead being placed upon clearly illustrating the principles of the present disclosure. Moreover, in the drawings, like reference numerals designate corresponding parts throughout the figures.

DETAILED DESCRIPTION

Figure 1:
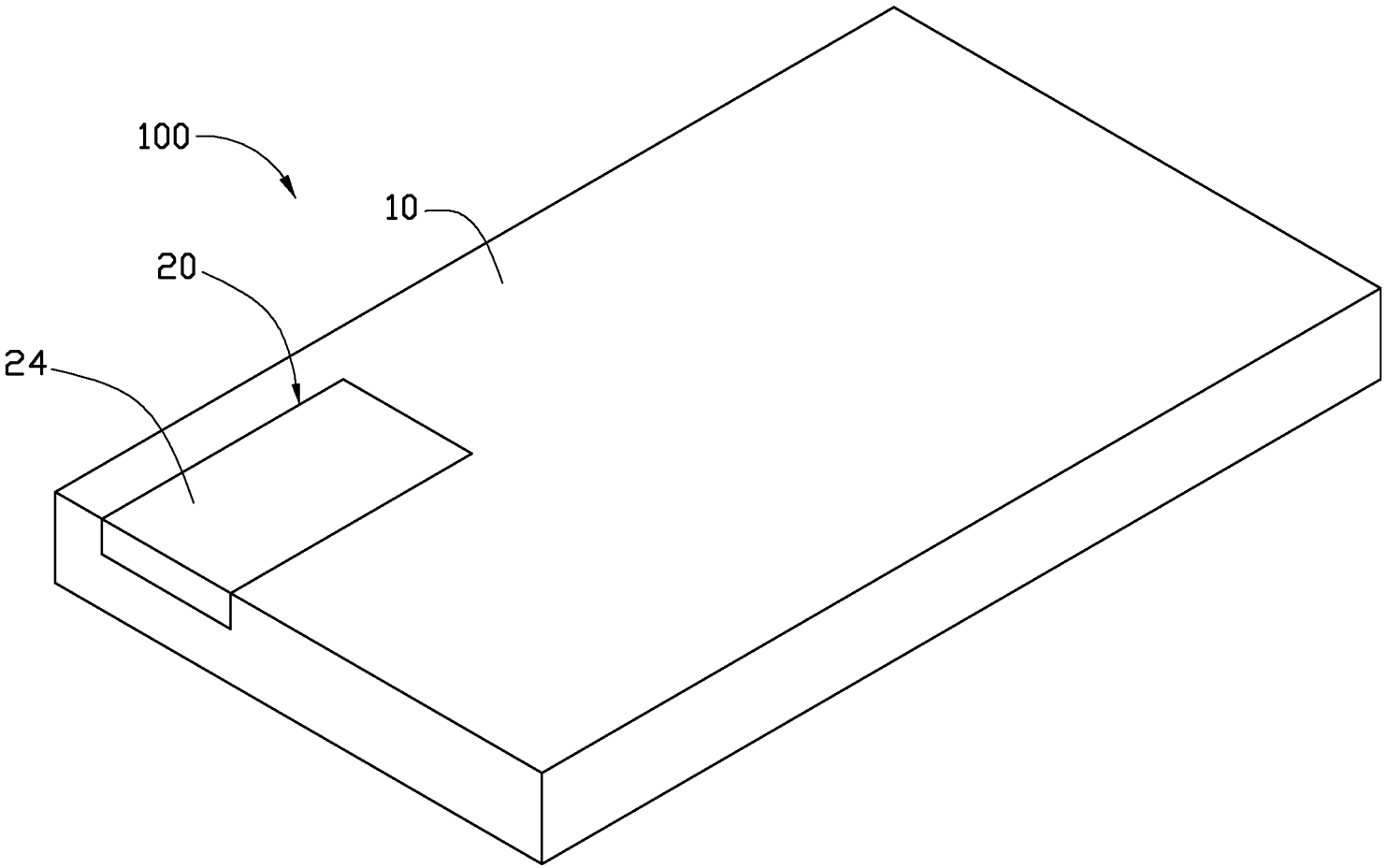
FIG. 1 is a perspective view of an electronic device as disclosed with an antenna assembly retracted.

FIG. 1 is a perspective view of an electronic device 100 as disclosed with an antenna assembly 20 retracted. The electronic device 100 includes a main body 10 and the antenna assembly 20. The electronic device 100 may be a mobile phone, a personal digital assistant (PDA), or a mobile Internet device (MID), for example.

Figure 2:
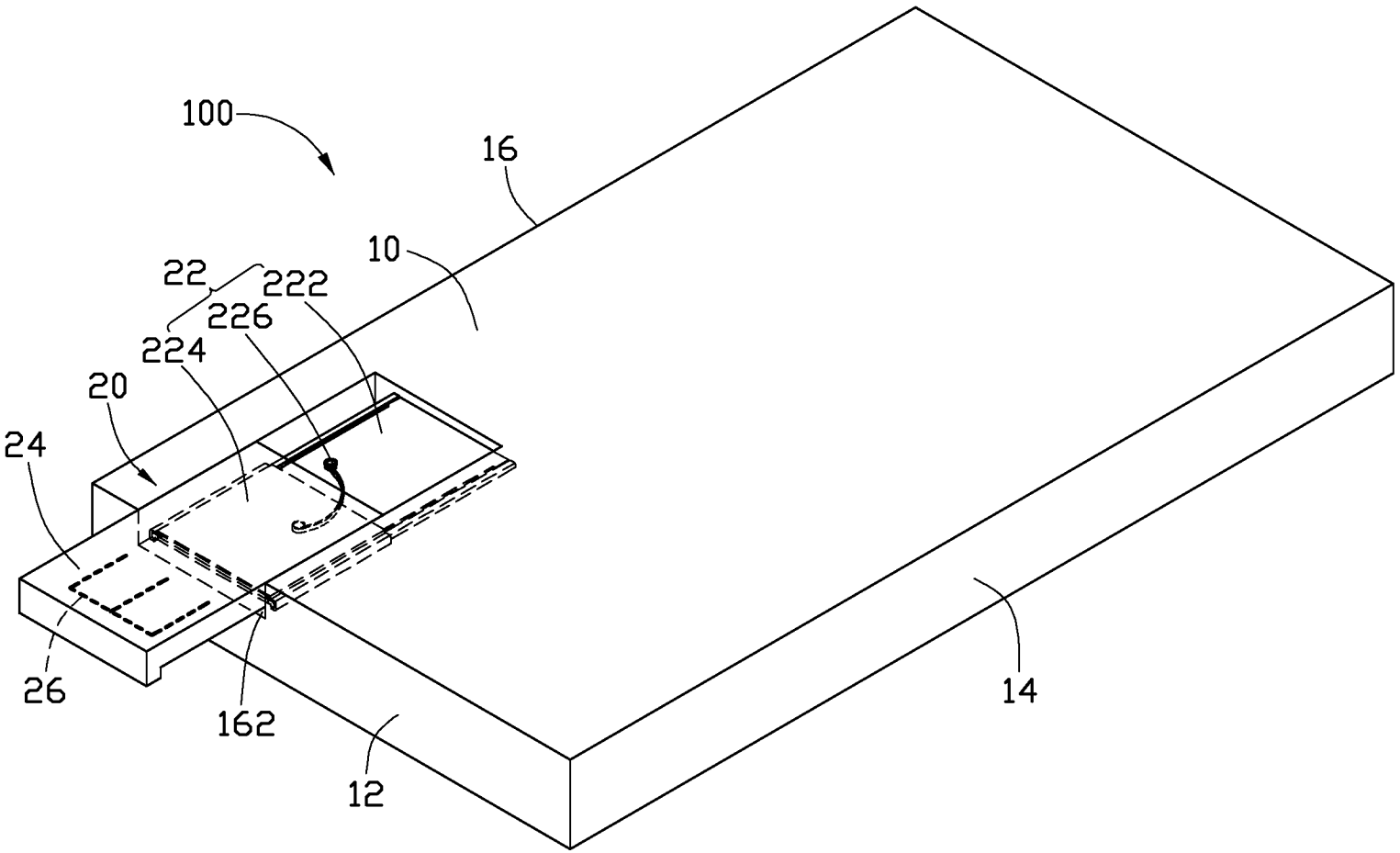
FIG. 2 is a perspective view of the electronic device of FIG. 1 with the antenna assembly extended.

FIG. 2 is a perspective view of the electronic device 100 of FIG. 1 with the antenna assembly 20 extended relative to the main body 10. The main body 10 includes two opposite ends 12, two opposite sides 14, and a surface 16 connected with the two opposite ends 12 and the two opposite sides 14. A receiving cavity 162 is further defined on the surface 16 and extends through one of the two opposite ends 12. The receiving cavity 162 receives the antenna assembly 20.

Figure 3:
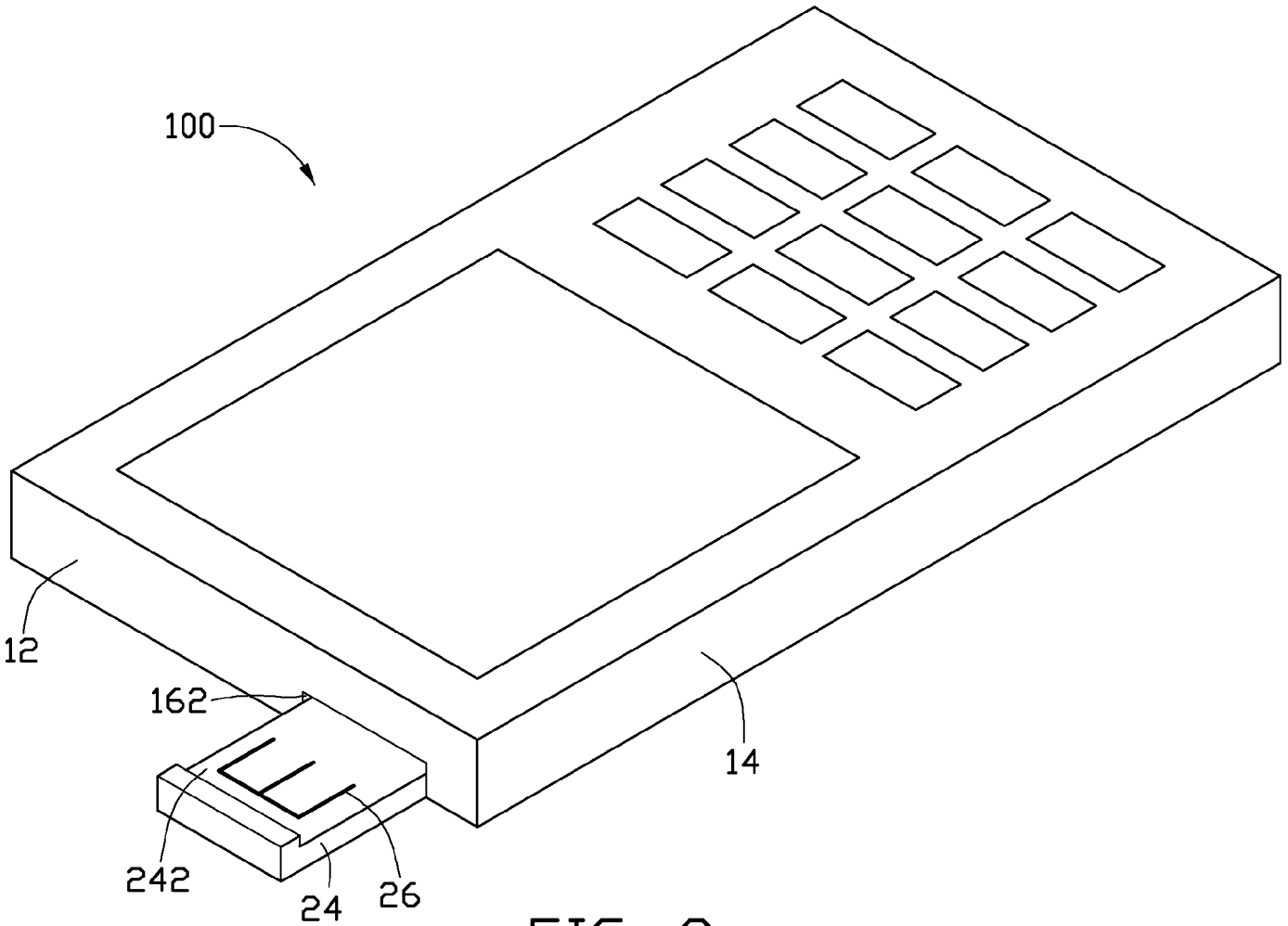
FIG. 3 is an inverted view of FIG. 2.

FIG. 3 is an inverted view of FIG. 2. The antenna assembly 20 includes a slide mechanism 22, a chassis 24, and an antenna 26. The slide mechanism 22 includes a fixed plate 222, a slide plate 224, and an elastic element 226. The fixed plate 222 is mounted in the receiving cavity 162 of the main body 10. The slide plate 224 is slidably mounted on the fixed plate 222. The elastic element 226 is installed between the fixed plate 222 and the slide plate 224. In the exemplary embodiment, the elastic element 226 is a leaf spring. The chassis 24 is mounted on the slide plate 224 and includes a surface 242 facing the fixed plate 222. The antenna 26 is installed on the surface 242.

Figure 4:
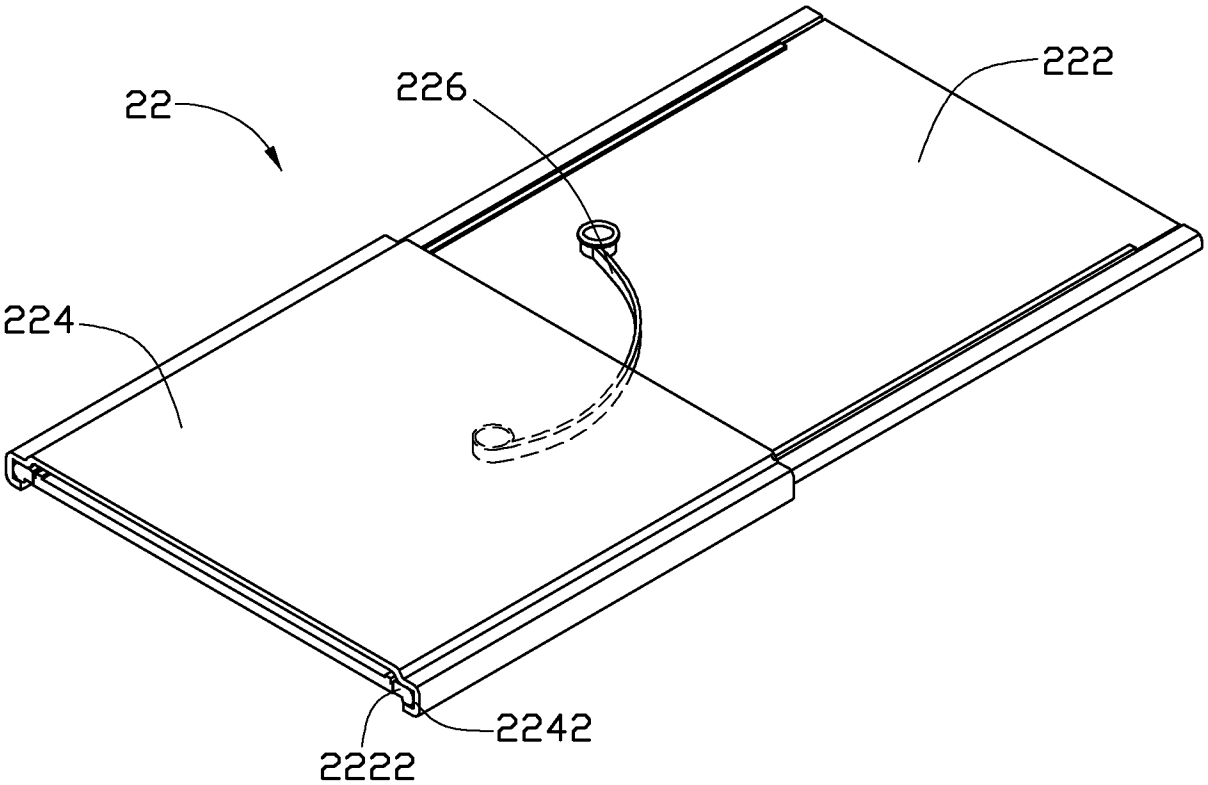
FIG. 4 is a perspective view of a slide mechanism of the antenna assembly of FIG. 2.

FIG. 4 is a perspective view of the slide mechanism 22 of the antenna assembly 20 of FIG. 2. A slide rail 2222 is installed on each side of the fixed plate 222. A slide portion 2242 is installed on each side of the slide plate 224. The slide portion 2242 is further slidably placed over the slide rail 2222, such that the slide plate 224 can slide along the slide rail 2222. Two ends of the elastic element 226 are individually pivoted on the fixed plate 222 and the slide plate 224.

The antenna 26 is contained between the fixed plate 222 and slide plate 224 when the chassis 24 is received in the receiving cavity 162. In this state, the slide mechanism 22 is retracted and the elastic element 226 pivots opposite to the antenna 26. The elastic element 226 resists the slide plate 224, such that the slide plate 224 is located on one end of the receiving cavity 162 away from the antenna 26. As a result, the chassis 24 is anchored in the receiving cavity 162 due to the resistance of the elastic element 226.

The antenna 26 is exposed when the chassis 24 is pushed away from the receiving cavity 162 by external force. In this state, the slide mechanism 22 is extended and the elastic element 226 pivots toward the antenna 26. The elastic element 226 is further compressed and then springs to release elasticity on the slide plate 224. As a result, the elasticity can accelerate the chassis 24 to slide away from the receiving cavity 162.

It is understood that the fixed plate 222 may be omitted, such that the slide plate 224 is directly slidably mounted on the receiving cavity 162. The elastic element 226 is installed between the receiving cavity 162 and the slide plate 224. The slide rail 2222 is installed on each side of the receiving cavity 162.

The present disclosure provides an antenna assembly and an electronic device using the same. The antenna assembly is received in the electronic device and may extend from the electronic device to enhance signal reception.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. An electronic device, comprising:

a main body comprising an end and a top surface connected with the end, a receiving cavity defined on the top surface and extending through the end; and an antenna assembly comprising:

a slide mechanism received in the receiving cavity, the slide mechanism comprising a fixed plate and a slide plate slidably mounted on the fixed plate;

a chassis mounted on one end of the slide plate, the chassis including an outer surface and an inner surface, the chassis exposed from the top surface, the outer surface of the chassis with the slide plate being coplanar with the top surface, and one end of the chassis being coplanar with the end of the main body;

an antenna mounted on the inner surface the chassis; and wherein the antenna is contained in the receiving cavity and facing the fixed plate when the chassis is received in the receiving cavity; and wherein the antenna is exposed out of the receiving cavity when the chassis with the slide plate is slid relative to the fixed plate.

2. The electronic device of claim 1, wherein the slide mechanism further comprises an elastic element installed between the fixed plate and the slide plate, a first end of the elastic element is pivoted on the fixed plate, and a second of the elastic element is pivoted on the slide plate.

3. The electronic device of claim 2, wherein the elastic element is a leaf spring.

4. The electronic device of claim 1, wherein a slide rail is installed on each side of the fixed plate, a slide portion is installed on each side of the slide plate, the slide portion is slidably placed over the slide rail to slide along the slide rail.

5. An electronic device, comprising:

a main body comprising an end and a top surface connected with the end, a receiving cavity defined on the top surface and extending through the end; and an antenna assembly comprising:

a slide plate slidably mounted in the receiving cavity;

a chassis mounted on one end of the slide plate the chassis including an outer surface and an inner surface, the chassis exposed from the top surface, the outer surface of the chassis with the slide plate being coplanar with the top surface, and one end of the chassis being coplanar with the end of the main body;

an antenna mounted on the inner surface the chassis; and wherein the antenna is contained in the receiving cavity when the chassis is received in the receiving cavity; and wherein the antenna is exposed out of the receiving cavity when the chassis with the slide plate is slid relative to the fixed plate.

6. The electronic device of claim 5, further comprising an elastic element installed between the main body and the slide plate, a first end of the elastic element is pivoted on the fixed plate, and a second of the elastic element is pivoted on the slide plate.

7. The electronic device of claim 6, wherein the elastic element is a leaf spring.

8. The electronic device of claim 5, wherein the antenna is mounted on one surface of the chassis toward the receiving cavity.

9. The electronic device of claim 5, wherein a slide rail is installed on each side of the fixed plate, a slide portion is installed on each side of the slide plate, the slide portion is slidably placed over the slide rail to slide along the slide rail.

* * * * *